US007210941B2

(12) United States Patent
Rosenberger

(10) Patent No.: US 7,210,941 B2
(45) Date of Patent: May 1, 2007

(54) COAXIAL PLUG-AND-SOCKET CONNECTOR HAVING RESILIENT TOLERANCE COMPENSATION

(75) Inventor: Bernd Rosenberger, Tittmoning (DE)

(73) Assignee: Rosenberger Hochfrequenztechnik GmbH, Fridolfing (DE)

( * ) Notice: Subject to any disclaimer, the term of this patent is extended or adjusted under 35 U.S.C. 154(b) by 0 days.

(21) Appl. No.: 11/529,026

(22) Filed: Sep. 28, 2006

(65) Prior Publication Data

US 2007/0026698 A1 Feb. 1, 2007

Related U.S. Application Data

(63) Continuation of application No. PCT/EP05/02994, filed on Mar. 21, 2005.

(51) Int. Cl.
*H01R 12/00* (2006.01)

(52) U.S. Cl. ..... 439/63

(58) Field of Classification Search ..... 439/63, 439/65, 66, 74, 581
See application file for complete search history.

(56) References Cited

U.S. PATENT DOCUMENTS

| | | | | |
|---|---|---|---|---|
| 4,295,009 | A | 10/1981 | Weidler et al. | |
| 4,925,403 | A * | 5/1990 | Zorzy | 439/578 |
| 5,242,316 | A * | 9/1993 | Gartzke et al. | 439/584 |
| 5,329,262 | A * | 7/1994 | Fisher, Jr. | 333/33 |
| 5,380,211 | A * | 1/1995 | Kawaguchi et al. | 439/74 |
| 5,466,160 | A * | 11/1995 | Ogura | 439/63 |
| 5,516,303 | A * | 5/1996 | Yohn et al. | 439/248 |
| 5,980,309 | A | 11/1999 | Frantz et al. | |
| 6,079,986 | A * | 6/2000 | Beshears | 439/63 |
| 6,126,487 | A * | 10/2000 | Rosenberger | 439/675 |
| 6,224,421 | B1 * | 5/2001 | Maturo, Jr. | 439/581 |
| 6,497,579 | B1 | 12/2002 | Garbini | |
| 6,699,054 | B1 * | 3/2004 | Critelli | 439/248 |
| 6,773,285 | B2 * | 8/2004 | Bernat et al. | 439/246 |
| 6,827,608 | B2 * | 12/2004 | Hall et al. | 439/578 |
| 6,908,325 | B2 * | 6/2005 | Bernat et al. | 439/246 |
| 7,112,078 | B2 * | 9/2006 | Czikora | 439/248 |
| 7,118,383 | B2 * | 10/2006 | Nagata et al. | 439/63 |
| 2004/0038586 | A1 * | 2/2004 | Hall et al. | 439/578 |
| 2004/0102061 | A1 * | 5/2004 | Watanabe | 439/63 |
| 2006/0024985 | A1 * | 2/2006 | Nagata et al. | 439/63 |

FOREIGN PATENT DOCUMENTS

| | | |
|---|---|---|
| EP | 0793299 | 9/1997 |
| EP | 1158627 | 11/2001 |
| EP | 1207592 | 5/2002 |

* cited by examiner

*Primary Examiner*—Ross Gushi
(74) *Attorney, Agent, or Firm*—DeLio & Peterson, LLC; Robert Curcio

(57) ABSTRACT

A coaxial plug-in connection, particularly for printed circuit boards. An outer and inner conductor are assigned to each board, and can be electrically connected to the outer or inner conductor of the other respective board via a sleeve-shaped plug-in adapter coupling that encompasses a corresponding outer conductor portion and an inner conductor portion. The inner conductor of the printed circuit board is a spring metal sheet, one end of which is fixed to the board or an insulating element, while the other end is free to engage with the inner conductor portion of the plug-in coupling, which is configured as a contact pin.

17 Claims, 1 Drawing Sheet

Fig. 1
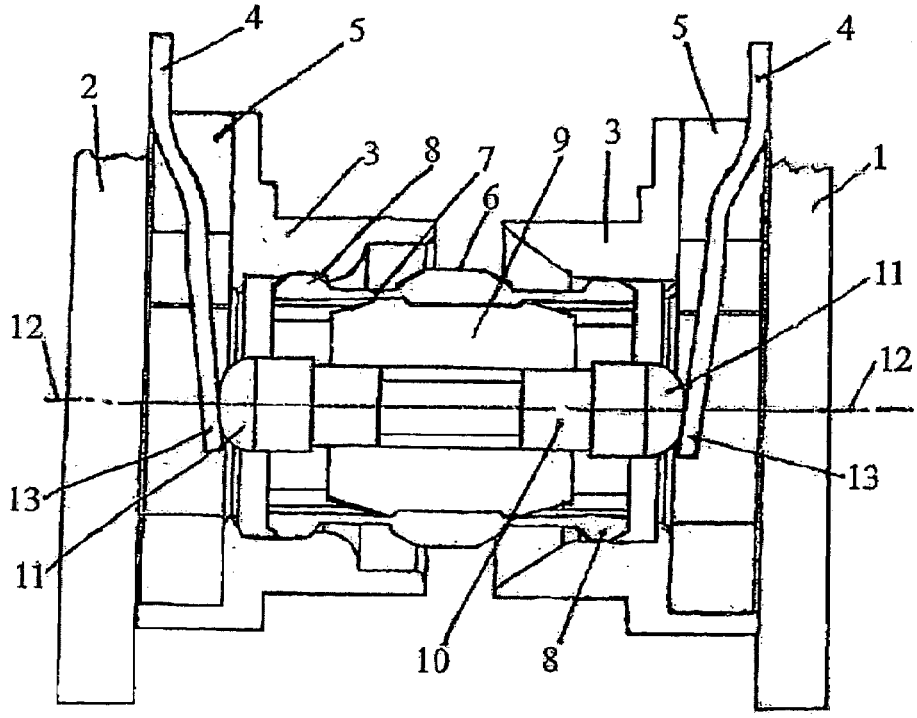
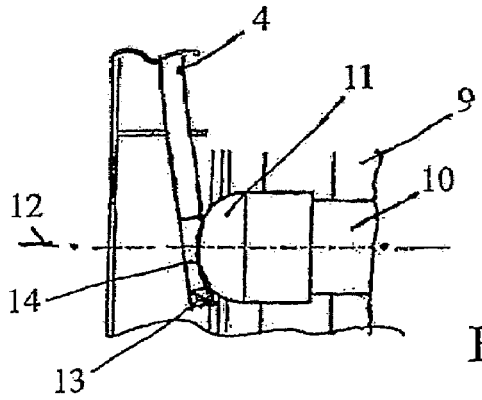
Fig. 2

COAXIAL PLUG-AND-SOCKET CONNECTOR HAVING RESILIENT TOLERANCE COMPENSATION

BACKGROUND OF THE INVENTION

1. Field of the Invention

The invention relates to a coaxial plug-and-socket connection, specifically for printed circuit boards.

2. Description of Related Art

In known coaxial plug-and-socket connectors of this kind, such as that described in German Patent No. DE 202 08 425.6, at least one socket forming an outer conductor and having an associated center conductor is usually fixed to each printed circuit board. The center conductor has, in this case, a contact pin, normally cylindrical, which can be plugged, in such a way as to be held in place resiliently, into a correspondingly shaped recess in the end-face of the center-conductor member of an adapter in the form of a sleeve-like plug-in coupler. The design is such that a defined air-gap is left between the outer-conductor socket and the end-face of the plug-in coupler.

Although coaxial plug-and-socket connectors of this kind normally meet the requirements they are called upon to meet sufficiently well, it has nevertheless been found that certain serious disadvantages do occur, doing so particularly at the high transmission frequencies which can be expected today, which may be as much as 60 GHz or more.

These disadvantages arise because even slight relative movements between the printed circuit boards which are connected together, both in the axial direction of the contact pins and also transversely thereto, cause an unwanted change in the contact zone between the contact pin of the center conductor and the center-conductor member of the female coupler. This in turn results in an unwanted change in the field resistance preset by the defined air-gap, which has a definite adverse effect on the quality of the electrical transmission.

These relative movements between the printed circuit boards, slight though they are, cannot be avoided and because of them there is no assurance, even with the known plug-and-socket connectors, that what is called repeatability of mating will remain the same, which is likewise considered a disadvantage.

Added to this, there is also the fact that the manufacture of coaxial plug-and-socket connectors of this kind involves a relatively high outlay in terms of time and money because there are always certain tolerances that have to be met in the connector, which has a commensurate effect on the cost of manufacture.

The object underlying the invention is therefore, in order to overcome the disadvantages described, to design the coaxial plug-and-socket connector of the generic kind in such a way that there is a crucial improvement in its repeatability of mating, particularly when the transmission frequencies are up to 60 GHz or more, and at the same time, while manufacture is considerably simplified and unwanted abrupt changes in the diameter of the contact pin are avoided, it is ensured that there is a contact zone which is good and remains equally good.

SUMMARY OF THE INVENTION

Bearing in mind the problems and deficiencies of the prior art, it is therefore an object of the present invention to provide a coaxial plug-and-socket connector that provides for improvement in its repeatability of mating, particularly when the transmission frequencies are up to 60 GHz or more.

It is another object of the present invention to provide a coaxial plug-and-socket connector that can accommodate relative movements between the printed circuit boards.

A further object of the invention is to provide a coaxial plug-and-socket connector that eliminates unwanted change in the field resistance preset by a defined air-gap.

Still other objects and advantages of the invention will in part be obvious and will in part be apparent from the specification.

The above and other objects, which will be apparent to those skilled in the art, are achieved in the present invention, which is directed to in a first aspect, a coaxial plug-and-socket connector for a printed circuit board, comprising: an outer conductor and a center conductor, the conductors adapted to be in electrical communication with, and electrically connected to, an outer conductor and center conductor, respectively, of a second coaxial plug-and-socket connector; and an adapter for connecting the coaxial plug-and-socket connector to the second coaxial plug-and-socket connector, the adapter including a sleeve-shaped plug-in coupler having a corresponding outer-conductor member and corresponding center conductor member forming a contact pin, such that the center conductor of the coaxial plug-and-socket connector comprises a resilient member in planar form held in place at the printed circuit board at one end and having its other end free for engagement with the center conductor member of the plug-in coupler. The resilient member may comprise a tongue-shaped form or strip-shaped form, and may be held in place under preloading. The resilient member may also be held in place by an insulator at one end.

The free end of the resilient member may project onto a longitudinal axis of the contact pin of the plug-in coupler at an angle. The free end of the resilient member may also include a perforation approximately in line with the axis of the contact pin of the plug-in-coupler. The contact pin may have rounded, spherical, or hemispherical ends.

The center conductor member of the adapter forming the contact pin may include a length such that, when the plug-in coupler is inserted and held in the outer conductor in socket form of the printed circuit board, the contact pin engages resiliently with the resilient member free end. The contact pin can be axially displaceable in the plug-in coupler.

In a second aspect, the present invention is directed to a coaxial plug-and-socket connector for a printed circuit board, comprising: an outer conductor and a center conductor, the conductors adapted to be in electrical communication with, and electrically connected to, an outer conductor and center conductor, respectively, of a second coaxial plug-and-socket connector; and an adapter for connecting the coaxial plug-and-socket connector to the second coaxial plug-and-socket connector, the adapter including a sleeve-shaped plug-in coupler having a corresponding outer-conductor member and corresponding center conductor member forming a contact pin, such that the center conductor of the coaxial plug-and-socket connector comprises a resilient member in planar form held in place at the printed circuit board at one end under preloading and having its other end free for engagement with the center conductor member of the plug-in coupler, the free end of the resilient member projecting onto a longitudinal axis of the contact pin of the plug-in coupler at an angle.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIG. 1 is a cross-sectional view of the preferred embodiment of the coaxial plug-and-socket connector according to the invention.

FIG. 2 is a cross-sectional view of a modified embodiment of the coaxial plug-and-socket connector according to the invention

DESCRIPTION OF THE PREFERRED EMBODIMENT(S)

In the case of the coaxial plug-and-socket connector according to the invention, the design is such that the center conductor of the printed circuit board is in the form of a resilient member of planar form which is held in place at the printed circuit board or at an insulator at one of its ends and at its other, free end can be brought into engagement with the center-conductor member of the plug-in coupler, which center-conductor member is in the form of a contact pin.

In an advantageous embodiment of the invention, the resilient member of planar form is of a tongue-like or strip-like form, which ensures that manufacture will be easy.

It is ensured that the contact between the center conductor of the printed circuit board and the center-conductor member, in the form of a contact pin, of the plug-in coupler is always good when, as is provided for in accordance with the invention, the resilient member of planar form is held in place under preloading.

The free end of the resilient member of planar form usefully projects onto the axis of the contact pin of the plug-in coupler at an angle. Because of this, no special steps need to be taken to ensure that there is always contact between the resilient member of planar form of the printed circuit board and the contact pin of the plug-in coupler.

If, as described, the resilient member of planar form is of a tongue-like or strip-like form, the free end of the resilient member of planar form usually makes contact with the given end of the contact pin by point contact. It is within the scope of the invention in this case for there to be provided at the free end of the resilient member of planar form a perforation, which is largely in line with the axis of the contact pin. This then produces linear, and usually circular, contact between the resilient member of planar form and the contact pin. A further definite reduction in the cost of manufacturing the coaxial plug-and-socket connector according to the invention is made when, in a further embodiment of the invention, the contact pin of the plug-in coupler has rounded or spherical and in particular hemispherical ends. A contact pin of this kind can be produced with an outlay on manufacture which is as low as possible and at the same time ensures that the contact between its ends and the free ends of the respective resilient members of planar form is always made with very high efficiency.

The contact pin is usefully of a length such that, when the plug-in coupler is inserted and held in the outer conductor in socket form of the printed circuit board, the said contact pin will engage resiliently, at whichever of its free ends is considered, with the free end of the resilient member of planar form.

A definite further improvement is made in the flexibility with which contact is made between the resilient member of planar form and the contact pin when, as is provided for in accordance with the invention, the contact pin is arranged to be axially displaceable in the plug-in coupler or rather within the insulator of the latter. This makes it possible, automatically as it were, for the contact between the contact pin and the resilient member of planar form to be centered at all times because, as dictated by the axial load coming from one or other side, the contact pin is capable of shifting to suit within its plug-in coupler. Contact between the resilient member of planar form and the end of the contact pin is ensured in this way at all times and with complete effectiveness.

The design according to the invention of the coaxial plug-and-socket connector can be implemented with considerably reduced manufacturing costs. At the same time, it affords the definite advantage that, if the possible relative movements that were mentioned occur between the printed circuit boards in the direction of the longitudinal axis of the contact pin and/or transversely thereto, a contact zone which is good and remains equally good is always ensured. This is due to the fact that, because of the form mentioned that the contact between the resilient member of planar form and the contact pin takes in accordance with the invention, the desired contact zone is always maintained even in the event of the contact pin tilting and/or being displaced longitudinally.

Finally, not only is the repeatability of mating of the coaxial plug-and-socket connector as a whole improved by this means but it is also ensured that the quality of the mating will always remain the same.

The coaxial plug-and-socket connector seen in FIG. 1 of the drawings, which is also known as a board-to-board connector, is used to connect two printed circuit boards 1, 2.

In this case an outer conductor 3, in the form of an outer-conductor socket, and a center conductor 4 are held in place on each of the printed circuit boards 1 and 2. The center conductor 4 is insulated from the outer-conductor socket 3 by means of an insulating part 5.

The printed circuit boards 1, 2 can be connected electrically by means of an adapter 6, this adapter 6 taking the form of a sleeve-like plug-in coupler. On its outside, the plug-in coupler 6 has a sleeve-like outer-conductor member 7 which, at its leading ends, can be brought into engagement and held in engagement, in the manner shown, with the respective outer-conductor sockets 3 of the printed circuit boards 1 and 2 by means of an surrounding annular bead 8.

The plug-in coupler 6 also has, with an insulator 9 interposed in relation to its sleeve-like outer-conductor member 7, a center-conductor member 10 which extends axially within the plug-in coupler 6 at the center thereof and which forms a contact pin. The special design of this contact pin 10 is such that it is hemispherical in form at both its ends 11 and projects out of the plug-in coupler 6 at each of the hemispherical ends in the manner shown.

In the embodiment shown, the contact pin 10 is arranged to be axially displaceable within the insulator 9.

The center conductor 4 of each of the printed circuit boards 1 and 2 takes the form of a strip-like resilient member of planar form which at one of its ends is held in place under preloading at the printed circuit board 1 or 2 or at the insulator 5 and which at its free end 13 projects onto or beyond the longitudinal center axis 12 of the coaxial plug-and-socket connector at an angle. When the plug-in coupler 6 is inserted and held in the outer-conductor sockets 3 of the printed circuit boards 1 and 2, this results in the contact pin 10 being in resilient engagement, at its hemispherical ends 11, with the free ends 13 of the respective resilient members of planar form 4 of the printed circuit boards 1 and 2.

Because of the constant elastically resilient connection which is obtained in this way between the free end 13 of the resilient member of planar form 4 and the spherical end 11 of the contact pin 10, it is thus ensured that effective contact, and hence an electrical connection, is always obtained regardless of the relative movements which always occur between the printed circuit boards 1, 2 in both the longitudinal direction and also the transverse direction. The effect is further increased by the fact of the contact pin 10 being, as mentioned, arranged to be axially displaceable within the plug-in coupler 6.

In the modified embodiment shown in FIG. 2, the free end 13 of the resilient member of planar form 4 has a perforation 14 which largely lines up with the axis 12 of the contact pin 10. In contrast to the embodiment shown in FIG. 1, where the contact obtained between the free end 13 of the resilient member of planar form 4 and the rounded end 11 of the contact pin 10 is largely point contact, this produces a contact between the edges of the perforation 14 in the resilient member of planar form 4 and the rounded end 11 of the contact pin 10 which is more or less in the form of a circular line. What is always ensured at the same time however is the flexibility of the contact and the centering thereof, which derives on the one hand from the basic arrangement of the resilient member of planar form 4 and on the other hand from the axial displaceability of the contact pin 10.

For features of the invention that are not explained in detail above, it is explicitly pointed out that reference should be made to the drawings and the claims.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A coaxial plug-and-socket connector for a printed circuit board, comprising:

an outer conductor and a center conductor, said conductors adapted to be in electrical communication with, and electrically connected to, an outer conductor and center conductor, respectively, of a second coaxial plug-and-socket connector;

an adapter for connecting said coaxial plug-and-socket connector to said second coaxial plug-and-socket connector, said adapter including a sleeve-shaped plug-in coupler having a corresponding outer-conductor member and corresponding center conductor member forming a contact pin, such that said center conductor of said coaxial plug-and-socket connector comprises a resilient member in planar form held in place at said printed circuit board at one end and having its other end free for engagement with said center conductor member of said plug-in coupler.

2. The coaxial plug-and-socket connector of claim 1 wherein said resilient member comprises a tongue-shaped form or strip-shaped form.

3. The coaxial plug-and-socket connector of claim 1 wherein said resilient member is held in place under preloading.

4. The coaxial plug-and-socket connector of claim 1 including having said resilient member held in place by an insulator at one end of said resilient member.

5. The coaxial plug-and-socket connector of claim 1 wherein said free end of said resilient member projects onto a longitudinal axis of said contact pin of said plug-in coupler at an angle.

6. The coaxial plug-and-socket connector of claim 5 wherein said free end of said resilient member includes a perforation approximately in line with said axis of said contact pin of said plug-in-coupler.

7. The coaxial plug-and-socket connector of claim 1 wherein said contact pin includes rounded, spherical, or hemispherical ends.

8. The coaxial plug-and-socket connector of claim 1 wherein said center conductor member of said adapter forming said contact pin includes a length such that, when said plug-in coupler is inserted and held in said outer conductor in socket form of said printed circuit board, said contact pin engages resiliently with said resilient member free end.

9. The coaxial plug-and-socket connector of claim 1 wherein said contact pin is axially displaceable in said plug-in coupler.

10. The coaxial plug-and-socket connector of claim 2 wherein said resilient member is held in place under preloading.

11. The coaxial plug-and-socket connector of claim 2 including having said resilient member held in place by an insulator at one end of said resilient member.

12. The coaxial plug-and-socket connector of claim 2 wherein said free end of said resilient member projects onto a longitudinal axis of said contact pin of said plug-in coupler at an angle.

13. The coaxial plug-and-socket connector of claim 12 wherein said free end of said resilient member includes a perforation approximately in line with said axis of said contact pin of said plug-in-coupler.

14. A coaxial plug-and-socket connector for a printed circuit board, comprising:

an outer conductor and a center conductor, said conductors adapted to be in electrical communication with, and electrically connected to, an outer conductor and center conductor, respectively, of a second coaxial plug-and-socket connector;

an adapter for connecting said coaxial plug-and-socket connector to said second coaxial plug-and-socket connector, said adapter including a sleeve-shaped plug-in coupler having a corresponding outer-conductor member and corresponding center conductor member forming a contact pin, such that said center conductor of said coaxial plug-and-socket connector comprises a resilient member in planar form held in place at said printed circuit board at one end under preloading and having its other end free for engagement with said center conductor member of said plug-in coupler, said free end of said resilient member projecting onto a longitudinal axis of said contact pin of said plug-in coupler at an angle.

15. The coaxial plug-and-socket connector of claim 14 wherein said contact pin includes rounded, spherical, or hemispherical ends.

16. The coaxial plug-and-socket connector of claim 14 wherein said center conductor member of said adapter forming said contact pin includes a length such that, when said plug-in coupler is inserted and held in said outer conductor in socket form of said printed circuit board, said contact pin engages resiliently with said resilient member free end.

17. The coaxial plug-and-socket connector of claim 14 wherein said contact pin is axially displaceable in said plug-in coupler.

* * * * *